US008857239B2

(12) United States Patent
Nishida et al.

(10) Patent No.: US 8,857,239 B2
(45) Date of Patent: Oct. 14, 2014

(54) TRANSFER BAR

(75) Inventors: Kenji Nishida, Hakusan (JP); Takashi Moriyasu, Komatsu (JP); Hidetoshi Akashi, Kanazawa (JO); Tomoya Kobayashi, Miki (JP)

(73) Assignees: Komatsu Ltd., Minato-ku, Tokyo (JP); Komatsu Industries Corp., Komatsu-shi, Ishikawa (JP); SR Engineering Co., Ltd., Kobe-shi, Hyogo (JP)

( * ) Notice: Subject to any disclaimer, the term of this patent is extended or adjusted under 35 U.S.C. 154(b) by 151 days.

(21) Appl. No.: 13/575,779

(22) PCT Filed: Dec. 16, 2010

(86) PCT No.: PCT/JP2010/072665

§ 371 (c)(1),
(2), (4) Date: Sep. 7, 2012

(87) PCT Pub. No.: WO2011/092965

PCT Pub. Date: Aug. 4, 2011

(65) Prior Publication Data

US 2012/0324979 A1 Dec. 27, 2012

(30) Foreign Application Priority Data

Jan. 27, 2010 (JP) ..... 2010-015292

(51) Int. Cl.
*B21D 43/05* (2006.01)

(52) U.S. Cl.
CPC ..... *B21D 43/055* (2013.01)
USPC ..... 72/405.11; 72/405.16; 72/405.05; 198/621.1

(58) Field of Classification Search
CPC ..... B21D 43/057; B21D 43/05; B21D 43/105
USPC ..... 72/405.5, 405.11, 405.12, 405.13, 72/405.14, 405.15, 405.16; 198/621.1, 198/468.01, 468.4, 468.6, 468.8, 468.9
See application file for complete search history.

(56) References Cited

U.S. PATENT DOCUMENTS

| | | | | |
|---|---|---|---|---|
| 3,577,834 A | | 5/1971 | Lang | |
| 4,540,087 A | * | 9/1985 | Mizumoto | 198/621.1 |
| 5,557,959 A | | 9/1996 | Wallis et al. | |
| 6,050,124 A | * | 4/2000 | Shiroza | 72/405.16 |

(Continued)

FOREIGN PATENT DOCUMENTS

| | | |
|---|---|---|
| CN | 1121449 A | 5/1996 |
| CN | 1913987 A | 2/2007 |

(Continued)

OTHER PUBLICATIONS

English translation of International Search Report dated Jan. 25, 2011 from International Application No. PCT/JP2010/072665, 2 pages.
Office Action issued Jan. 10, 2014 from corresponding Chinese Application No. 201080062451.8, including English translation, 11 pages.

(Continued)

*Primary Examiner* — David B Jones
(74) *Attorney, Agent, or Firm* — Fish & Richardson P.C.

(57) ABSTRACT

A connecting device connecting a remaining bar and a movable bar of a transfer bar includes a remaining-side clamp and a movable-side clamp. The clamps respectively have a male fitted portion and a female fitted portion that are fitted to one another around a connecting direction, defining a first connector. A male engagement portion and a female engagement portion are provided inside the clamps, defining a second connector. The female engagement portion of the second connector includes a sphere in a form of a movable member moving in a direction orthogonal to the connecting direction. A movement of the sphere effects an engagement and disengagement of the female engagement portion from the male engagement portion.

6 Claims, 9 Drawing Sheets

(56) References Cited

U.S. PATENT DOCUMENTS

| | | | | |
|---|---|---|---|---|
| 7,410,046 | B2 * | 8/2008 | Shiroza | 198/468.4 |
| 7,690,238 | B2 * | 4/2010 | Shiroza | 72/405.11 |
| 8,640,614 | B2 * | 2/2014 | Nishida et al. | 72/405.16 |
| 2002/0100665 | A1 | 8/2002 | Noda | |
| 2002/0144533 | A1 * | 10/2002 | Shiroza | 72/405.1 |
| 2006/0260381 | A1 | 11/2006 | Reichenbach | |
| 2009/0039580 | A1 | 2/2009 | Tokunaga et al. | |
| 2009/0064753 | A1 | 3/2009 | Tokunaga et al. | |

FOREIGN PATENT DOCUMENTS

| | | | |
|---|---|---|---|
| CN | 100553819 | C | 10/2009 |
| JP | S53-71177 | U | 6/1978 |
| JP | 560-010752 | Y2 | 4/1985 |
| JP | S64-033320 | U | 3/1989 |
| JP | H04-075804 | A | 3/1992 |
| JP | H06-054429 | U | 7/1994 |
| JP | 2006-289478 | A | 10/2006 |

* cited by examiner

TRANSFER BAR

TECHNICAL FIELD

The invention relates to a transfer bar, more specifically a connecting mechanism for a transfer bar installed on a workpiece transfer device of a press machine

BACKGROUND ART

A transfer press, i.e. a press machine installed with a plurality of processing stations within its press body, is provided with a workpiece transfer device that transfers workpieces in sequence among the processing stations. The workpiece transfer device includes a pair of transfer bars mounted in parallel with a direction in which workpieces are transferred, each of the transfer bars being provided with detachable workpiece holders capable of holding and releasing workpieces depending on a position and a type of dies disposed in respective processing stations.

The dies need to be replaced according to a type of the workpiece (type of product). A lower die, the die normally installed on a moving bolster, is transferred from the press body to the exterior together with the moving bolster, simultaneously with an upper die that is released from a slide. In other words, when replacing the dies, dies are changed to desired ones by a die-replacing work, or the moving bolster is replaced with another one already installed with predetermined dies.

In the meantime, the workpiece holder that has to be replaced depending on a type of workpiece as in the case of the dies needed to be replaced with in the press machine because the workpiece holder is mounted on the transfer bar of the workpiece transfer device that is independent of the moving bolster. While replacing the workpiece holder, the press machine was unable to operate, causing a roadblock to an improvement in operating rates of the press machine. Hence, the transfer bar is separated into a movable bar positioned in the middle and two fixed bars at both ends, allowing the workpiece holder to be transferred to the exterior and moved back inside along with dies by the moving bolster together with the movable bar on which the workpiece holder is mounted.

Many of connecting mechanisms in which a detachable movable bar and fixed bars (hereinafter referred to as remaining bars) are connected are ones in which a plate-shaped engagement member provided on the remaining bars is locked with an engagement body of the movable bar as disclosed in the below Patent Literature 1. For other information, Patent Literature 2 discloses a mechanism, in which plate-shaped connectors of the remaining bars and another connector of the movable bar are connected by a pin disposed in a vertical direction perpendicular to a longitudinal direction of each of the bars, while with respect to a vertical direction of the two plate-shaped connectors, dampers on the remaining bars function as holding means, enabling three-dimensional binding of the connectors in each direction.

CITATION LIST

Patent Literature(s)

Patent Literature 1: UTILITY MODEL PUBLICATION 06-054429

Patent Literature 2: JP-A-2006-289478

SUMMARY OF INVENTION

Problem(s) to be Solved by the Invention

However, a connecting mechanism disclosed in Patent Literatures 1 and 2, in which dampers and the plate-shaped engagement members provided on the remaining bars make vertical and pivotal movement, has low rigidity against loads imposed in a horizontal direction because the dampers and the engagement members are vertically engaged or disengaged from an engaged part on the movable bar, although the mechanism is sufficiently resistant against loads vertically applied by either the self weight of the transfer bar or an acceleration of speed at which the transfer bar is vertically moved. Accordingly, an attempt to drive the transfer bar faster to increase productivity of the press machine turns horizontally-imposed loads on connectors of each of the bars into significant bending moment, in addition to creating vertically-applied loads on the connectors, thus being unable to resist the bending moment. An increase in the size of the device to strengthen resistance against horizontally-charged loads would raise the weight of the device, preventing fast driving of the transfer bar.

An object of the invention is to provide a transfer bar with higher rigidity of the connectors and lighter weight.

Means for Solving the Problem(s)

In consideration of the above problems, a transfer bar according to a first aspect of the invention includes: a remaining bar remaining inside a press body; a movable bar that is adapted to be transferred to and from the press body; and a connecting device that detachably connects the remaining bar and the movable bar, the connecting device including a remaining-side clamp attached to the remaining bar and a movable-side clamp attached to the movable bar, the remaining-side clamp including one of a male fitted portion and a female fitted portion that are fitted to one another around a connecting direction, the movable-side clamp having the other of the male fitted portion and the female fitted portion, the male fitted portion and the female fitted portion defining a first connector, in which a male engagement portion and a female engagement portion are accommodated inside the male and female fitted portions of the remaining-side clamp and the movable-side clamp, the male engagement portion being provided on one of the remaining-side clamp and the movable-side clamp and extending toward the other of the remaining-side clamp and the movable-side clamp, the female engagement portion being provided on the other of the remaining-side clamp and the movable-side clamp and engaging with an outer circumference of the male engagement portion, the male and female engagement portion defining a second connector, the female engagement portion of the second connector including a movable member moving in a direction orthogonal to the connecting direction, a movement of the movable member effecting an engagement and disengagement of the female engagement portion from the male engagement portion.

In the transfer bar according to a second aspect of the invention, the movable member is capable of moving by being rolled.

In the transfer bar according to a third aspect of the invention, the movable member includes a plurality of movable members around the connecting direction.

In the transfer bar according to a fourth aspect of the invention, the female engagement portion of the second connector includes a plunger moving forward and backward in the connecting direction, an end of the plunger having a slant surface coming in slide contact with the movable member and effecting a movement of the movable member to an interior when the plunger advances.

In the transfer bar according to a fifth aspect of the invention, the movable member engages with the male engagement portion while the movable member is pressed against the male engagement portion by the slant surface.

In the transfer bar according to a sixth aspect of the invention, the male fitted portion is defined by an outer circumference of a truncated cone tapering toward an end in the connecting direction, while the female fitted portion is defined by an inner circumference of a truncated cone having a diameter increasing toward the end in the connecting direction.

Effect(s) of the Invention

In the first aspect of the invention, the male and female fitted portions on the remaining-side clamp and the movable-side clamp of the connecting device that define the first connector include a predetermined inner area that accommodates the male and female engagement portions and a large fitted surface around the connecting direction that enables fitting between the male fitted portion and the female fitted portion, thus significantly increasing rigidity of a connecting part between the remaining bar and movable bar when the connecting device is used. Hence, the connecting device reliably resists a bending moment generated on the connecting part even when large loads are applied onto the connecting part in a direction orthogonal to the connecting direction, so that a speed at which the transfer bar is driven can be increased.

Since the connecting part receives less loads that separate both of the bars away from one another in a longitudinal direction as compared to a bending moment, the male and female engagement portions that define the second connector are required only to maintain an engagement of the male and female engagement portions that prevents separation of the bars in a longitudinal direction, necessitating only the male and female engagement portions with a simplified structure. The simplified structure of the second connector reduces weights of the connecting device and the entire transfer bar, ensuring facilitation of high-speed driving of the transfer bar.

In the second aspect of the invention, an ability of the movable member to roll and move facilitates the movement of the movable member and expedites the engagement of the male and female engagement portions on the second connector, while causing less abrasion and simplifying lubrication, thus facilitating maintenance of the connecting device.

In the third aspect of the invention, the movable member that includes a plurality of movable members arranged around the connecting direction effects the engagement of the male and female engagement portions in a well-balanced manner, keeping the engagement in good conditions.

In the fourth aspect of the invention, an advancement of the plunger, by which the movable member is moved on a slant surface provided on the plunger, changes a direction in which the plunger is moved in the connecting direction to the direction orthogonal to the connecting direction, thus ensuring a movement of the movable member toward the male engagement portion.

In the fifth aspect of the invention, the slant surface presses the movable member toward the male engagement portion, keeping the movable member from shaky movement while the male and female engagement portions are engaged, so that a connection between the bars is kept in better conditions.

In the sixth aspect of the invention, the male and female fitted portions that have a truncated conic shape are fitted with each other. Thus the fitted surfaces of the male and female fitted portions can be closely contacted, resulting in an increased rigidity and reliable resistance against a greater bending moment.

BRIEF DESCRIPTION OF DRAWING(S)

DESCRIPTION OF EXEMPLARY EMBODIMENT(S)

First Exemplary Embodiment

Figure 1:
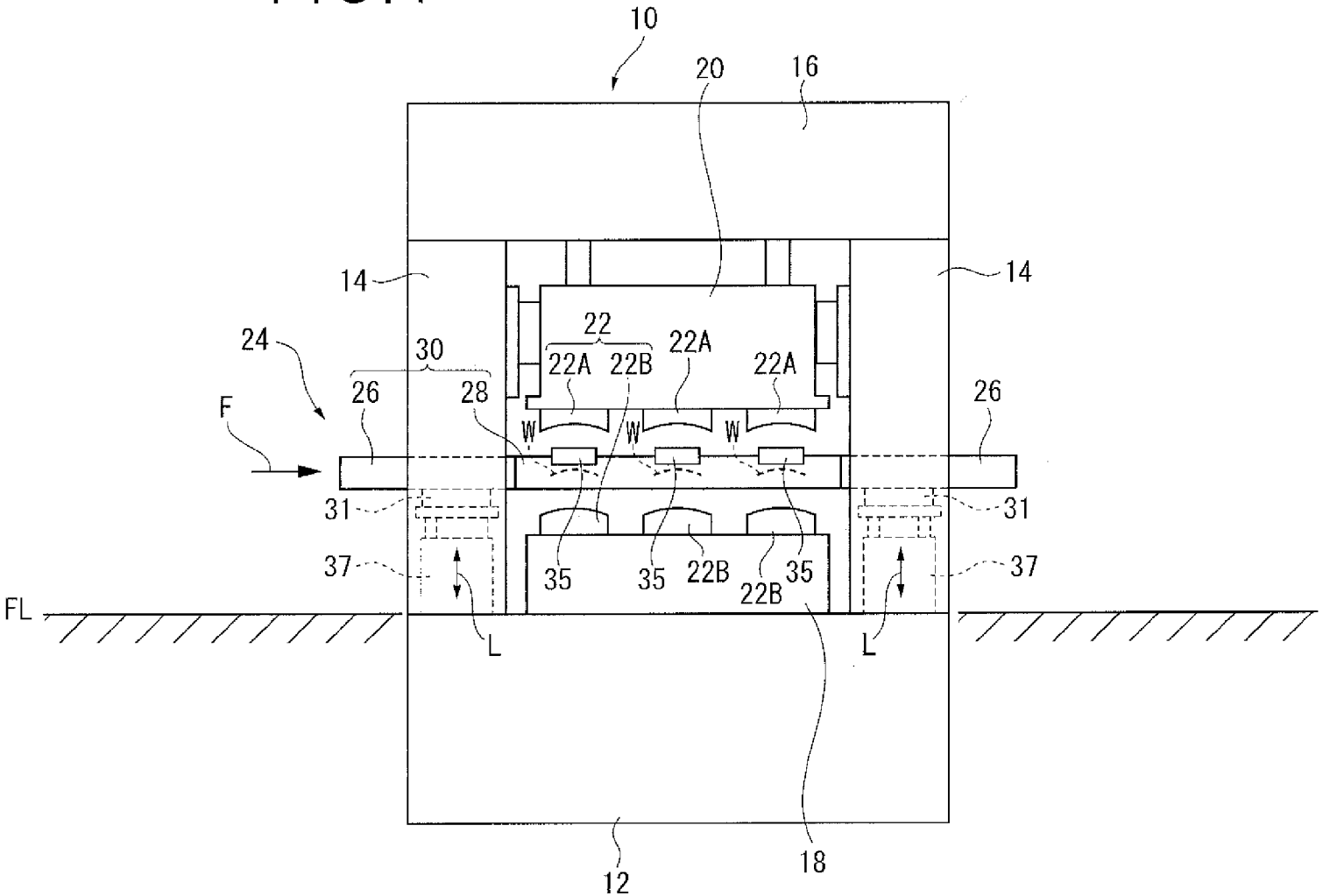
FIG. 1 is a front view of a press machine using a transfer bar according to a first exemplary embodiment of the invention.

The following is a detailed description of a first exemplary embodiment of the invention with reference to drawings. FIG. 1 shows a transfer press 10 (a press machine) in a front view. The transfer press 10 has a bed 12 installed under a floor FL, the bed 12 having a rectangular shape in a plan view. Columnar uprights 14 are vertically mounted at the four corners of the bed 12 in a plan view. A crown 16 is supported on the four uprights. The crown 16 has a slide 20 vertically mounted, enabling vertical movements of the slide 20 by an appropriate driving mechanism within the crown 16. These components constitute a press body of the transfer press 10.

A moving bolster 18 is disposed on the bed 12. The moving bolster 18 is configured such that the moving bolster 18 can be smoothly transferred from the press body to the exterior or moved back inside using appropriate guiding member including a rail. Detachable lower die 22B, one of dies 22 for processing workpiece, is mounted on an upper surface of the moving bolster 18. Detachable upper die 22A, the other of the dies 22, is provided on a lower surface of the slide 20. Then, predetermined workpiece W that matches the dies 22 are positioned on the lower die 22B before carrying out press work by lowering the upper die 22A along with the slide 20.

The transfer press 10 is provided with a workpiece transfer device 24 that newly feeds the workpiece W to be pressed or feeds the workpiece W to a next processing station in sequence. The workpiece transfer device 24 is provided with a pair of elongated transfer bars 30 extending in parallel to a direction in which the workpiece W is transferred. In FIG. 1, the workpiece W is transferred from the left to the right. The transfer bar 30 is disposed in a pair on each of the front side and the depth side in a direction perpendicular to the plane of FIG. 1 orthogonal to the transferring direction (referred to as "a clamping direction" discussed later). Each of the transfer bar 30 is installed with detachable workpiece holder 35 corresponding to the type of the workpiece W.

Figure 2:
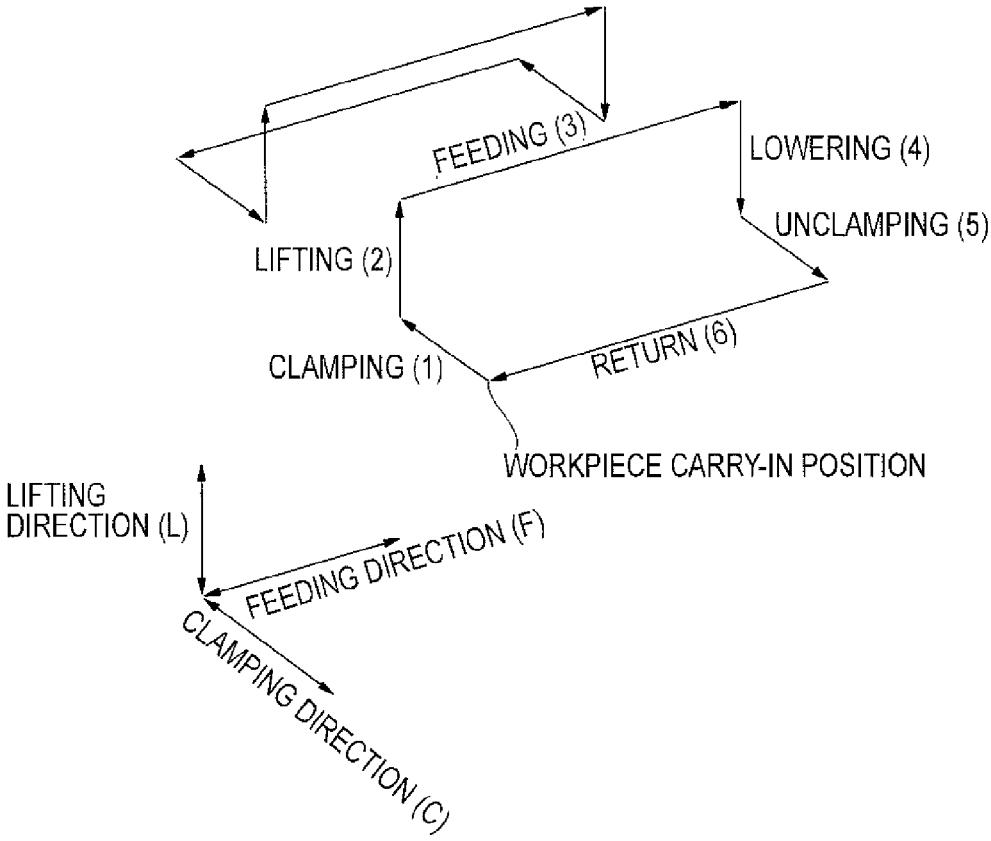
FIG. 2 illustrates movements of the transfer bar.

As shown in FIG. 2, both a feeding direction in agreement with the workpiece transfer direction and a returning direction opposite to the feeding direction are collectively referred to as a feeding direction F. Likewise, both a lifting direction perpendicular to the feeding direction F and a lowering direction opposite to the lifting direction are also collectively referred to as a lifting direction L. Both a clamping direction perpendicular to the directions F and L, the direction in which the two transfer bars 30 are approaching each other, and an unclamping direction opposite to the clamping direction, are also collectively referred to as a clamping direction C. The transfer bars 30 installed with workpiece holder 35 are normally driven in the three-dimensional directions F, L, C, but there are cases in which the transfer bars 30 are driven vertically two-dimensionally i.e. in the feeding direction F and the lifting direction L, or horizontally two-dimensionally i.e. in the feeding direction F and the clamping direction C.

The workpiece transfer device 24 having the transfer bar 30 as an element comprises: a bar-driving mechanism, such as a feeding driving mechanism 31 using a linear motor, whereby the transfer bar 30 is driven in the feeding direction F; and lifting and clamping driving mechanism 37, enabling the driving of the transfer bar 30 in the lifting direction L and the clamping direction C.

When the transfer press 10 presses different types of workpiece, the die 22 and the workpiece holder 35 have to be exchanged to predetermined die 22 and workpiece holder 35 in accordance with the type of the workpiece. To do so, each of the transfer bars 30 should be connected in a manner that allows for separating the transfer bar into a movable bar 28 in the middle mounted with the workpiece holder 35 and two remaining bar 26 at ends. Then, used dies 22 including upper dies 22A are placed on the moving bolster 18, so are the movable bar 28 fixed with used workpiece holder 35. The moving bolster 18 is transferred outside the press body, where replacement is carried out by a die-replacing work, increasing efficiency in replacement. Another way to shorten replacing time and improve efficiency of the replacement is to prepare in advance another moving bolster 18 installed with another movable bar 28 attached with predetermined workpiece holder 35 in addition to the predetermined die 22 and replace with the moving bolster 18.

During a press work, the transfer bar 30 is forced to move in a direction indicated in FIG. 2 by the driving mechanism 31 and 37. For instance, the transfer bar 30, positioned in alignment with a feeding direction F, is driven from a workpiece carry-in position, in which workpiece W is stored, in the clamping direction C to grip a workpiece W such as a plate by the workpiece holder 35 (Step 1: Clamping). Secondly, the workpiece W is gripped and lifted (Step 2: Lifting), then moved to an original processing station while maintaining a predetermined height at which the workpiece is held (Step 3: Feeding). The height where the workpiece is held is lowered while staying in the same position (Step 4: Lowering) Furthermore, the workpiece W is released from the workpiece holder 35 and placed on the lower die 22B, then withdrawn in the clamping direction C (Step 5: Unclamping), and returned to the workpiece carry-in position in the feeding direction F (Step 6: Return). The movement is also applied when the workpiece W is transferred from a predetermined processing station to a downstream processing station.

As indicated above, the transfer bar 30 is given mobility to move three-dimensionally in each of the directions (F, L, and C). To improve productivity of the transfer press 10, an increase in rates of driving the transfer 30 in each of the directions is required. However, the increase in the driving rates would cause a significant rise in a speed at which the elongated and heavyweight transfer bar 30 is moved, causing substantial loads. Accordingly, in the exemplary embodiment in which the transfer bar 30 is separated into the remaining bars 26 and the movable bar 28 that are connected in usage, a load forcing the remaining bars 26 and the movable bar 28 to disconnect one another, i.e. a bending moment, is generated on a connecting part, indicating a necessity to make the connecting part resistant against the bending moment.

The transfer bar 30 experiences a rise in speed in a longitudinal direction caused by driving in the feeding direction F, but has no bending moment generated on the connecting part between the remaining bars 26 and the movable bar 28, thus leaving a matter of strength less critical against acceleration in the feeding direction F as compared to a case in which a bending moment is created when the acceleration is caused in the clamping direction C and the lifting direction L.

Figure 3:
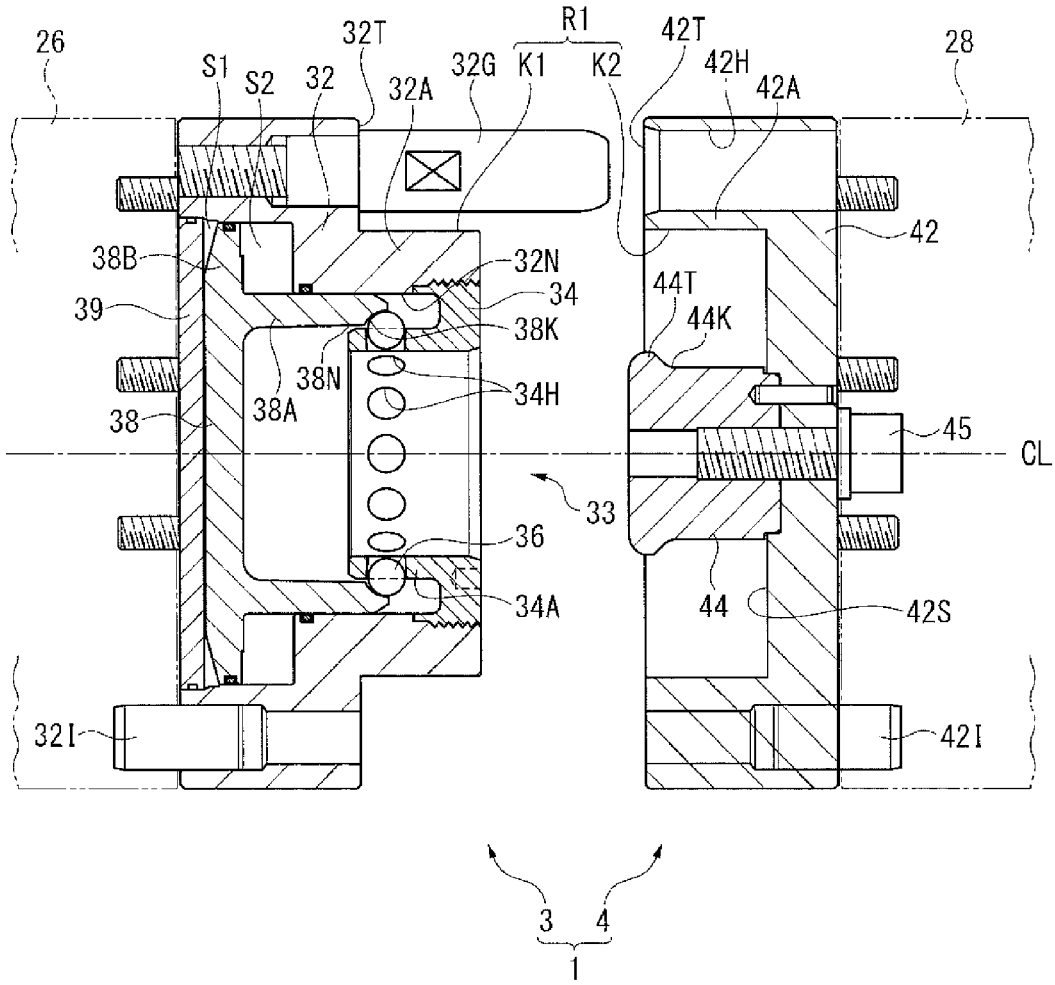
FIG. 3 is a longitudinal sectional view of a connector when the transfer bar is separated.
Figure 4:
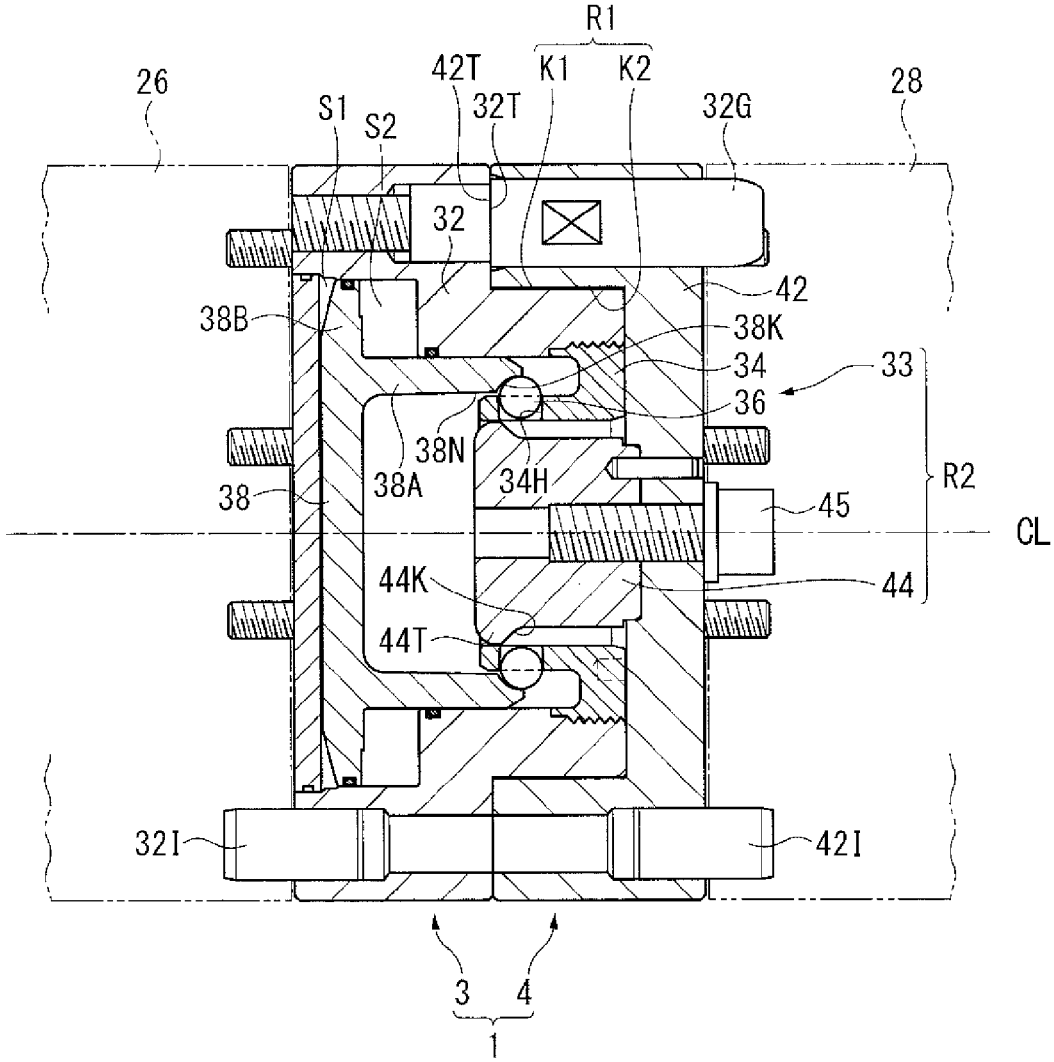
FIG. 4 is a longitudinal sectional view showing a connecting operation underway from a state of being separated.
Figure 5:
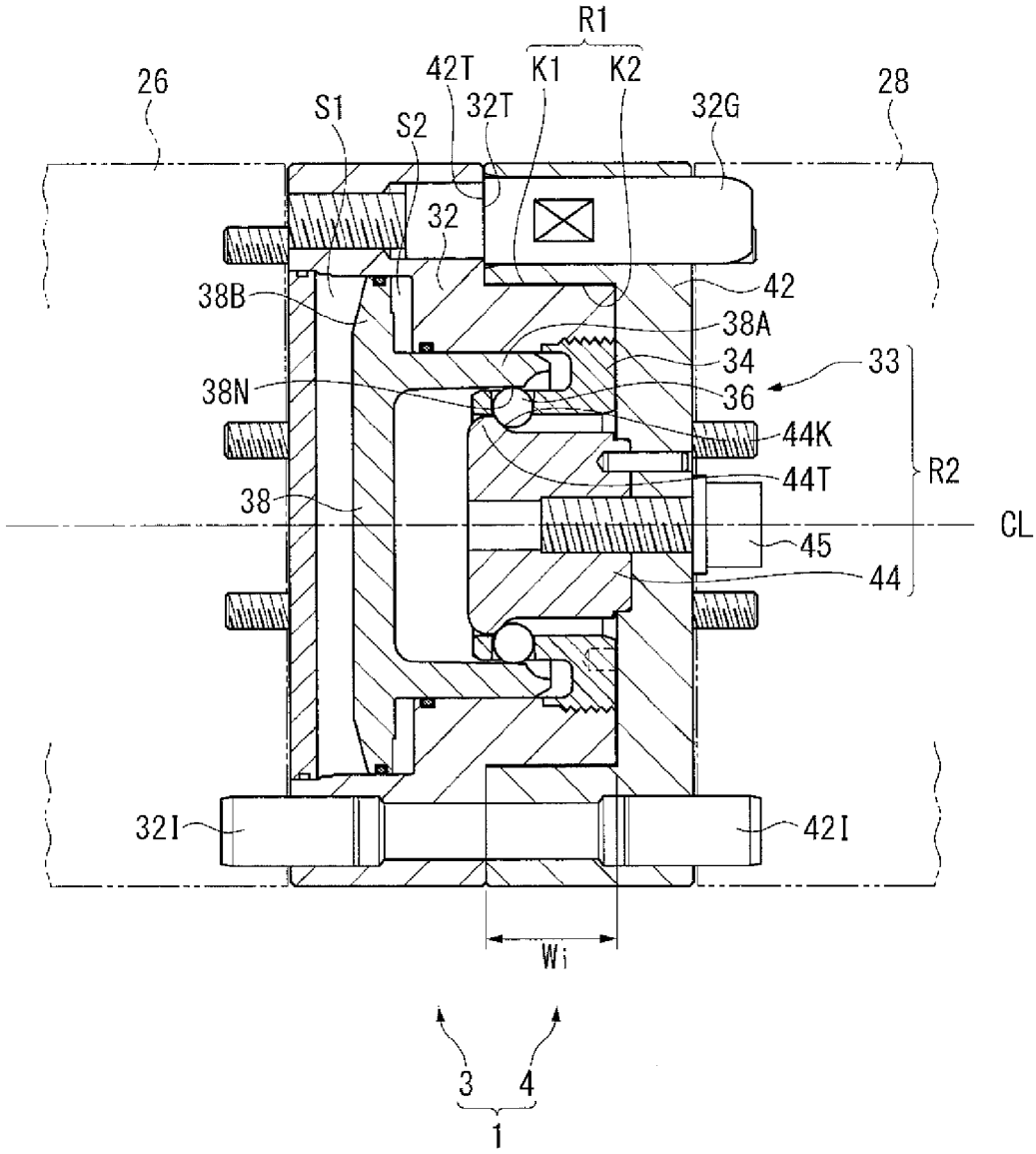
FIG. 5 is a longitudinal sectional view showing the connecting operation completed after a process midway through the connecting operation.

The following is a statement by reference to FIGS. 3 to 5. In the exemplary embodiment, the remaining bars 26 and the removable bar 28 are attachable with and detachable from one another by a connecting device 1. The connecting device 1 comprises: a remaining-side clamp 3 protruding outwardly along a central axis CL from an end of the remaining bar 26 on the left in the figures; and a movable-side clamp 4 protruding outwardly along the central axis CL from an end of the movable bar 28 on the right in the figures.

The remaining-side clamp 3 includes a remaining-side outer component 32 that is convex in cross section and attached to the end of the remaining bar 26 by a bolt. An end of the remaining-side outer component 32 is an outer cylindrical portion 32A that has a cylindrical shape. An outer circumference of the outer cylindrical portion 32A provides a male fitted portion K1 whose bus bar is parallel to the central axis CL. An inner circumference of the outer cylindrical portion 32A is mounted, for instance, by screwing, with a retainer 34 extending inwardly (to the left in FIG. 3) from an end of an opening of the outer cylindrical portion 32A. An end of the retainer 34 is an inner cylindrical portion 34A that has a cylindrical shape coaxial with the same central axis CL. A plurality of penetrating holes 34H are equidistantly provided on a circumference of a middle part (i.e. a predetermined position in a longitudinal direction) of the inner cylindrical portion 34A.

Each of the penetrating holes 34H is provided with a sphere 36 (a movable member) from a side of an outer circumference of the inner cylindrical portion 34A. Each of the penetrating holes 34H is provided in a truncated conic shape, tapering off toward the central axis CL, thus preventing the sphere 36 in the penetrating hole 34H from entering into the inside of the inner cylindrical portion 34A. According to the configuration above, the sphere 36 is placed in plural around connecting direction of both bars 26 and 28. The sphere 36 is a steel ball with its surface being smoothed.

Inside the remaining-side outer component 32, a plunger 38 is disposed to be opposed to the retainer 34 in a direction of the central axis CL. Plunger 38 is configured to be able to move forward and backward along the central axis CL. The plunger 38 is provided with an intermediate cylindrical portion 38A that is interposed between the outer cylindrical portion 32A and the inner cylindrical portion 34A when the plunger 38 moves toward the retainer 34.

The intermediate cylindrical portion 38A is guided to an inner surface 32N of the outer cylindrical portion 32A when the plunger 38 moves forward or backward. An inner surface of an end of the intermediate cylindrical portion 38A provides a recess 38K that is substantially circular in cross section. The recess 38K is positioned in the vicinity of the sphere 36 held by the retainer 34, preventing the sphere 36 from getting outside through the penetrating hole 34H of the retainer 34. However, the recess 38K does not need to have a spherical surface, but may be a simple sloping surface that is tapered toward the end of the intermediate cylindrical portion 38A.

A space S1 is defined between a back side of the plunger 38 (the left side in FIG. 3) and a cover 39 disposed on a back side of the remaining-side outer component 32. The space S1 is configured in a manner capable of feeding of compressed air at a predetermined pressure level to the interior from a proper external pneumatic device, as well as discharging the compressed air from the interior. Also, a space S2 is defined between a front side of a flange 38B of the plunger 38 and an inner end of the outer cylindrical portion 32A, allowing for feeding compressed air at a predetermined pressure level to the interior from a proper external pneumatic device as well as discharging the compressed air from the interior. In other words, the space S1 and S2 create a cylinder space for the plunger 38 to move forward and backward.

The sphere 36, the retainer 34 and the plunger 38 constitute a female engagement portion 33. A pin 32I that determines a position in fixing to the remaining bar 26 and a plurality of guide pins 32G are installed at a predetermined position on the remaining-side outer component 32.

On the other hand, the movable-side clamp 4, while being bolted to an end of the movable bar 28, includes a movable-side outer component 42 that has a bottomed cylindrical shape and a bottom to be fitted to the remaining-side outer component 32 of the remaining-side clamp 3. A cylindrical portion 42A protruding toward the remaining bar 26 is provided on the movable-side outer component 42. An inner circumference of the cylindrical portion 42A provides a female fitted portion K2 to which a male fitted portion K1 of the remaining outer component 32 is fitted. Inside the movable-side outer component 42, a cylindrical male engagement portion 44 that protrudes toward the remaining outer component 32 along the central axis CL is fixed at the center of a bottom 42S by a bolt 45.

An outer circumference of an end of the male engagement portion 44 provides an annular engaging convex portion 44T that is larger in outer diameter than a rear anchor, and a (vertical) cross-sectional view of the engaging convex portion 44T in FIG. 3 is substantially semicircular or has an arc shape and a contour of the outer circumference has a smooth shape. A portion adjacent to and inside the engaging convex portion 44T (the right side in FIG. 3) is the recess 44K that is defined by the presence of the engagement convex portion 44T. The recess 44K becomes engaged to the sphere 36, as discussed later.

On the cylindrical portion 42A of the movable outer component 42, the pin 42I that determines a position in fixing to the movable bar 28 is provided at an appropriate position, while a guiding hole 42H in parallel to the central axis CL is provided in a position corresponding to a guide pin 32G on the remaining-side outer component 32. Cooperation of the guide pin 32G and guiding hole 42H facilitates connection between the remaining bar 26 and the movable bar 28. FIG. 4 shows a state in which ends of the bars 26 and 28 are pressed in a direction of the central axis CL so that both bars 26 and 28 are connected.

In the above state of the connecting device 1, a first connector R1 according to the invention is provided by a fitting part between the male fitted portion K1 of the remaining-side clamp 3 and the female fitted portion K2 of the movable-side clamp 4. The first connector R1 is positioned outwardly (greater in diameter) as compared to a second connector R2 (FIG. 5) discussed below. Furthermore, each of the fitted portions K1 and K2 are fitted to one another with a larger width Wi (FIG. 5) continuous in a circumferential direction by which the fitted portions are fitted, so that a larger fitting area is secured to improve rigidity, thus resulting in greater resistance against a larger bending moment.

As shown in FIGS. 4 and 5, when the remaining-side outer component 32 of the remaining-side clamp 3 and the movable-side outer component 42 of the movable-side clamp 4 are fitted to one another, an opposed surface 32T provided with the guide pin 32G abuts an opposed surface 42T provided with the guide hole 42H, while an end of the remaining-side outer component 32 comes very close to the bottom 42S of the movable-side outer component 42. This is also desirable in resisting the bending moment applied on the connecting part between both bars 26 and 28.

In a process in which the movable bar 28 is inserted into the remaining bar 26 (i.e. from FIG. 3 to FIG. 4), the sphere 36 that is held by the retainer 34 is pressed outwards by the engaging convex portion 44T of the male engagement portion 44, enabling insertion of the male engagement portion 44 into the retainer 34 without being blocked by the sphere 36.

When feeding compressed air at a predetermined pressure level into the space S1 in a state of FIG. 4, the plunger 38 advances, allowing the intermediate cylindrical portion 38A of the plunger 38 to roll and push halfway in the advancement the sphere 36 in the penetrating hole 34H toward the center of the inner cylindrical portion 34A of the retainer 34 by the recess 38K at the end of the intermediate cylindrical portion 38A. Then, as shown in FIG. 5, the sphere 36 is in slide contact with a slant surface 38N provided at a gentle slant angle inside the intermediate cylindrical portion 38A. Thus the sphere 36 is covered by the slant surface 38N from outside to press the sphere 36 against the recess 44K of the male engagement portion 44.

Hence, the male engagement portion 44 and the female engagement portion 33 become engaged to one another via the sphere 36, completing a connection between the remaining bar 26 and the movable bar 28. An engagement part between the male engagement portion 44 and the female engagement portion 33 defines the second connector R2 according to the invention.

The second connector R2, as discussed earlier, receives loads that are applied in a longitudinal direction of the transfer bar 30, among the loads imposed on the transfer bar 30, creating no binding moment. Therefore, in the exemplary embodiment in which the second connector R2 is designed only to receive the loads via a predetermined plurality of the spheres 36, the second connector R2 sufficiently resists the loads applied in a longitudinal direction.

To separate the transfer bar 30 again, compressed air at a predetermined pressure level is fed to the space S2 indicated in FIG. 5 from a predetermined external pneumatic device, while compressed air in the space S1 on a back side of the plunger 38 is discharged. The plunger 38 thereby returns to a state shown in FIG. 4. Later on, both bars 26 and 28 can be separated by relatively distancing the bars from one another in a longitudinal direction.

According to the exemplary embodiment discussed so far, the first connector R1, i.e. a connector with high rigidity, adequately resists the bending moment on the connecting part generated by a high-speed driving of the remaining bar 26 and the movable bar 28, due to a large area of the fitted surface of the two bars on the connecting device 1. The second connector R2 that does not require high rigidity still sufficiently resists the loads charged in a longitudinal direction that does not create bending moment, i.e. loads applied in a direction for separating the bars 26 and 28.

Second Exemplary Embodiment

Figure 6:
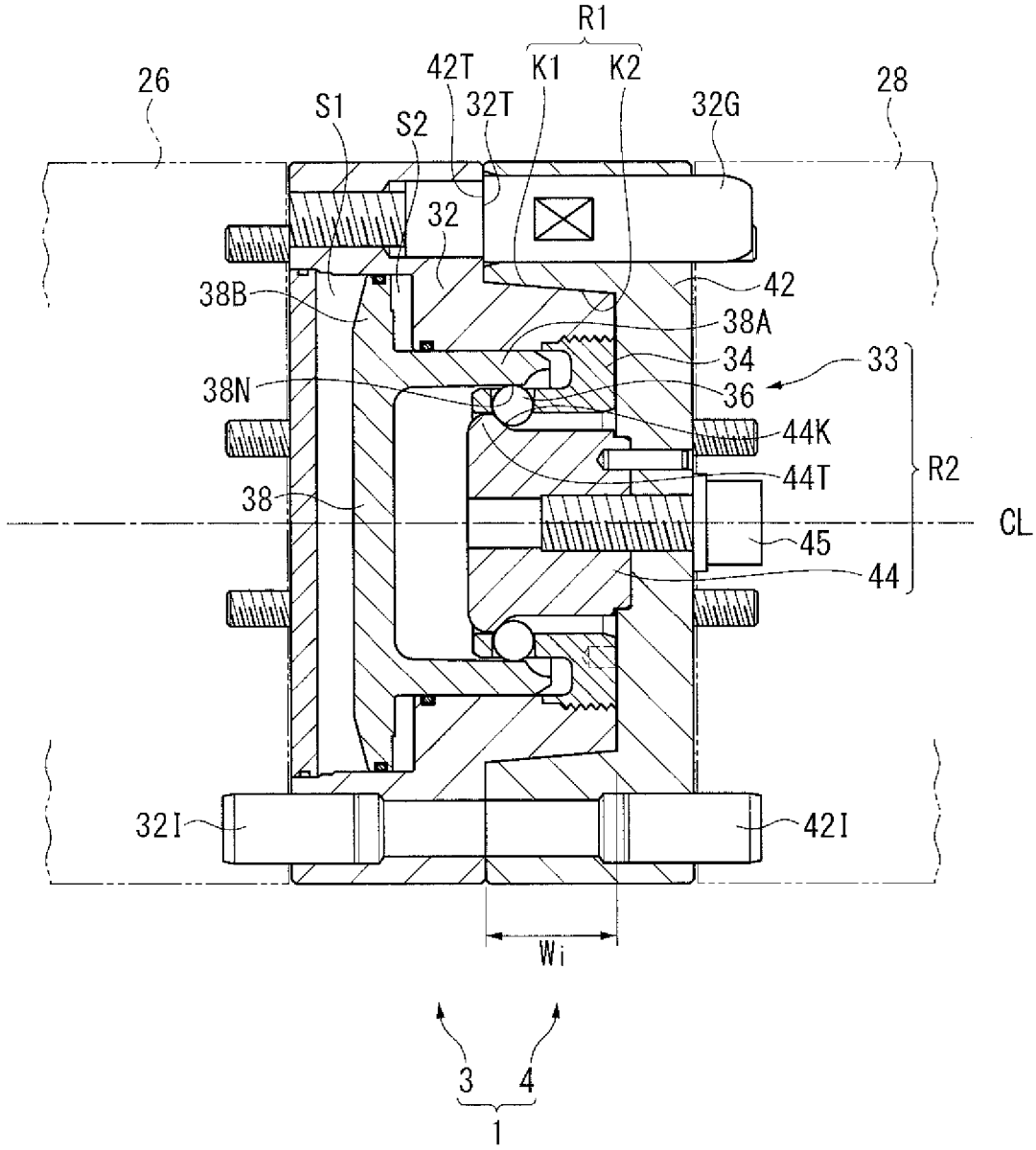
FIG. 6 is a longitudinal sectional view of a connector of a transfer bar according to a second exemplary embodiment of the invention.

FIG. 6 shows a second exemplary embodiment of the invention. Whereas the male fitted portion K1 and the female fitted portion K2 on the first connector R1 are disposed on a surface parallel to the central axis CL in the first exemplary embodiment, the two portions are provided by a truncated conical surface in the second exemplary embodiment. In other words, the male fitted portion K1 is provided by a tapered surface on an outer circumference of a truncated cone tapering toward an end in a fitting direction (the same as the connecting direction), while the female fitted portion K2 is provided by a tapered surface on an inner circumference of a truncated cone of which diameter increases toward an end of the fitting direction.

The second exemplary embodiment offers an advantage of increasing rigidity in a connection between the bars 26 and 28 by ensuring contact between the fitted portions K1 and K2 to the entire circumference.

Third Exemplary Embodiment

Figure 7:
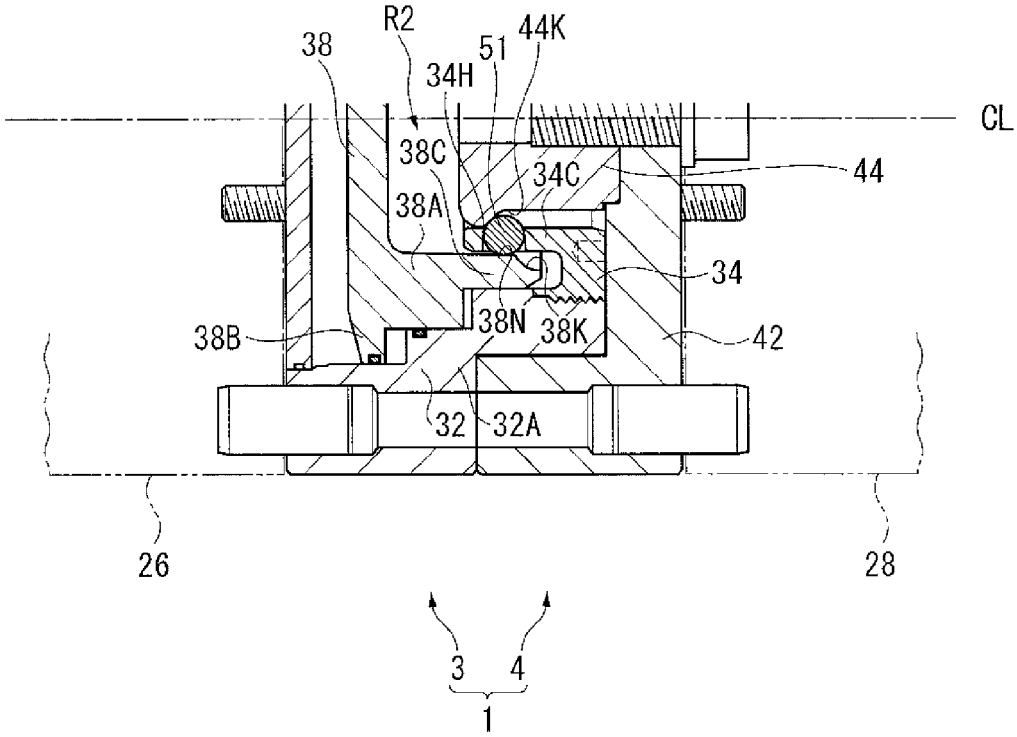
FIG. 7 is a longitudinal sectional view of a connector of a transfer bar according to a third exemplary embodiment of the invention.

FIG. 7 shows a third exemplary embodiment of the invention. Whereas the first exemplary embodiment uses the sphere 36 (a moveable member according to the invention), the exemplary embodiment employs a roller 51 that has a cylindrical shape with a predetermined length. The retainer 34 is provided with a square shell-shaped inner square hollow portion 34C in lieu of the inner cylindrical portion 34A discussed in the first exemplary embodiment. Each of members of the inner square hollow portion 34C is provided with the penetrating hole 34H (a square opening), each accommodating the roller 51.

On the other hand, the end of the intermediate cylindrical portion 38A on the plunger 38 defines an intermediate square hollow portion 38C. An inner circumference of the outer cylindrical portion 32A on the remaining-side outer component 32 is defined by a multi-level surface created by a circular opening in contact with an outer circumference of the intermediate cylindrical portion 38A of the plunger 38 and a square opening in contact with an outer circumference of the intermediate square hollow portion 38C. The advancement of the plunger 38 allows the intermediate square hollow portion 38C to be inserted between the square opening of the outer cylindrical portion 32A and the inner square hollow potion 34C of the retainer 34.

On the other hand, the male engagement portion 44 of the movable-side clamp 4 has a square-column shape as in a fourth exemplary embodiment discussed later (See FIG. 9) instead of a cylindrical shape, so that the roller 51 rolls and moves into the recess 44K provided in all four sides.

Other shapes and movements of each member of the invention in the third exemplary embodiment are approximately the same as in the first exemplary embodiment, thus offering the same advantages as in the first exemplary embodiment.

Fourth Exemplary Embodiment

Figure 8:
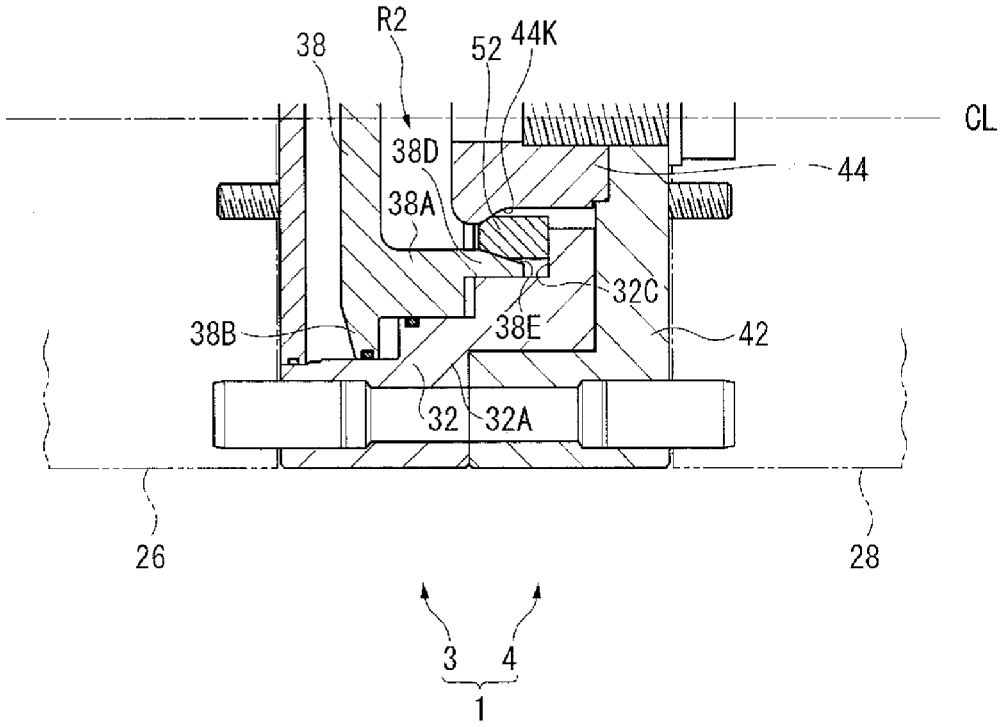
FIG. 8 is a longitudinal sectional view of a connector of a transfer bar according to a fourth exemplary embodiment of the invention.
Figure 9:
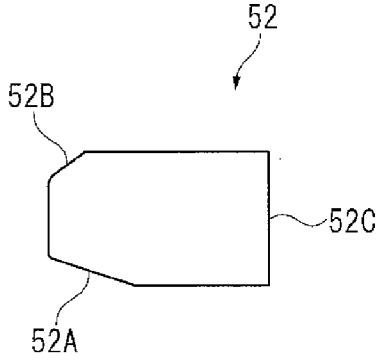
FIG. 9 is a side view of a component used in the fourth exemplary embodiment.
Figure 10:
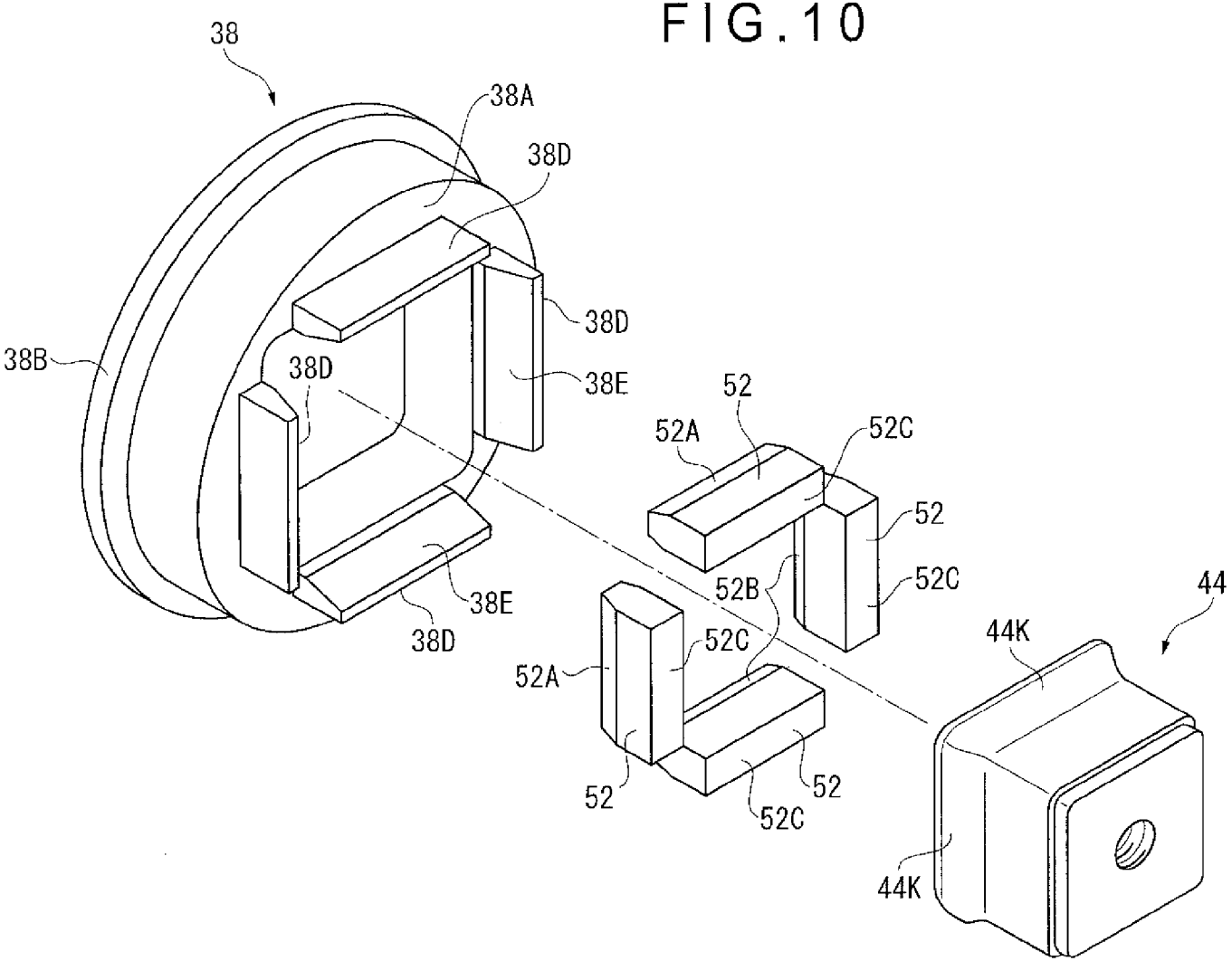
FIG. 10 is an exploded perspective view of a core part in the fourth exemplary embodiment.

FIGS. 8 to 10 show a fourth exemplary embodiment of the invention. The invention comprises a square column component 52 (a movable member according to the invention). The plunger 38 that is similar to one used in the third exemplary embodiment using the roller 51 includes a wedge portion 38D that fits each edge of the square opening, instead of the intermediate square hollow portion 38C used in the third exemplary embodiment.

An inner part of the wedge portion 38D is provided with a slant surface 38E that is inclined against the central axis CL with a space created by the slant surface widening toward an end of the wedge portion 38D. The remaining-side outer component 32 is provided with a wall 32C opposed to the end of the wedge portion 38D. A part defined by the slant surface 38E and the wall 32C houses the square column component 52. The wall 32C provides a surface orthogonal to the central axis CL.

The square column component 52 is provided in a longitudinal direction with a slide contact surface 52A in contact with the slant surface 38E on the wedge portion 38D, an engaging surface 52B that is slanted and engaged to the recess 44K of the male engagement portion 44 that has a square-column shape, and an abutment surface 52C that abuts the wall 32C.

In this exemplary embodiment, an advancement of the plunger 38 when the male engagement portion 44 of the movable-side clamp 4 is being inserted in the remaining-side clamp 3 causes the wedge portion 38D (i.e. an end of the plunger 38) to come in contact with the slide contact surface 52A of the square column component 52, so that the square column component 52 moves toward the central axis CL while the abutment surface 52C abuts the wall 32C. As a result, the engaging surface 52B of the square column component 52 becomes engaged to the recess 44K that is defined by a slant surface on the male engagement portion 44, completing a connection between the clamps 3 and 4 by the second connector R2.

On the other hand, a retreat of the plunger 38 causes the slant surface of the recess 44K to press the engaging surface 52B of the square column component 52 by a subsequent movement of the male engagement portion 44 away from the remaining-side clamp 3, pushing the square column component 52 outwards from the central axis CL. This returns the square column component 52 to an original position. The square column component 52 returned to the original position is required to be retained by some retaining means, however, detailed description and illustration of the retaining means are omitted here.

In the fourth exemplary embodiment above, the invention sufficiently resists loads applied on the connecting part between the bars 26 and 28 in a longitudinal direction by the second connector R2, providing the same advantages as in the first exemplary embodiment.

The invention is not limited to configurations discussed in each of the above exemplary embodiments and includes deformations and changes made to such an extent that an object of the invention can be achieved.

For instance, in each of the exemplary embodiments, with regard to the first connector R1, the male fitted portion K1 is provided on the remaining-side bar while the female fitted portion K2 is provided on the movable-side bar. However, each of the fitted portions may be provided on the other bar. Furthermore, with respect to the second connector R2, the female engagement portion 33 is provided on the remaining-side bar while the male engagement portion 44 is provided on the movable-side bar, but each of the engagement portions may be provided on the other bar.

The invention claimed is:

1. A transfer bar of a press machine, the press machine having a press body, the transfer bar comprising:

a remaining bar coupled to the press body;

a movable bar configured to be movable relative to the press body; and a connecting device that detachably connects the remaining bar and the movable bar, the connecting device comprising a remaining-side clamp attached to the remaining bar and a movable-side clamp attached to the movable bar, the remaining-side clamp and the movable-side clamp being configured to be connected to each other, wherein the remaining-side clamp comprises one of a male fitted portion and a female fitted portion and the movable-side clamp comprises the other of the male fitted portion and the female fitted portion, the male and female fitted portions being configured to be fitted to each other along an axis parallel to a connecting direction of the remaining-side clamp and the movable-side clamp, the male fitted portion and the female fitted portion defining a first connector, a female engagement portion and a male engagement portion being provided in an inner space defined by the first connector, and wherein the male engagement portion is provided on one of the remaining-side clamp and the movable-side clamp and extends toward the other of the remaining-side clamp and the movable-side clamp, and wherein the female engagement portion is provided on the other of the remaining-side clamp and the movable-side clamp and configured to engage with an outer circumference of the male engagement portion, the male and female engagement portion defining a second connector, the female engagement portion of the second connector comprising a movable member moving in a direction orthogonal to the connecting direction, a movement of the movable member effecting an engagement and disengagement of the female engagement portion from the male engagement portion.

2. The transfer bar of the press machine according to claim 1, wherein the movable member has a shape that enables the movable member to roll while being moved relative to the press body.

3. The transfer bar of the press machine according to claim 1, wherein the movable member comprises a plurality of movable members that are arranged about the axis parallel to the connecting direction.

4. The transfer bar of the press machine according to claim 1, wherein the female engagement portion of the second connector comprises a plunger configured to move forward and backward in a direction parallel to the connecting direction, an end of the plunger having a slant surface configured to come in contact with the movable member and to enable sliding movement of the slant surface relative to the movable member, wherein the slant surface is configured to, based upon movement of the plunger toward the movable member, radially move the movable member toward the male engagement portion of the second connector, the movable member being pressed against the male engagement portion by the slant surface.

5. The transfer bar of the press machine according to claim 4, wherein the movable member is configured to, based upon the slant surface pressing the movable member against the male engagement portion, engage with the male engagement portion.

6. The transfer bar of the press machine according to claim 1, wherein the male fitted portion is defined by an outer circumference of a truncated cone, and the female fitted portion is defined by an inner circumference of a truncated cone, the outer circumference of the truncated cone of the male fitted portion being configured to be received by the inner circumference of the truncated cone of the female fitted portion.

* * * * *